US005364324A

United States Patent [19]

Boettiger, Jr.

[11] Patent Number: 5,364,324

[45] Date of Patent: Nov. 15, 1994

[54] EXERCISE DEVICE

[76] Inventor: Walter W. Boettiger, Jr., 227 S. Ivy La., Glen Mills, Pa. 19342

[21] Appl. No.: 83,479

[22] Filed: Jun. 30, 1993

Related U.S. Application Data

[63] Continuation-in-part of Ser. No. 990,087, Dec. 14, 1992, abandoned.

[51] Int. Cl.[5] ..... A63B 23/14

[52] U.S. Cl. ..... 482/46; 482/118

[58] Field of Search ..... 482/44, 45, 46, 49, 482/50, 92, 93, 114, 115, 118, 121, 126

[56] References Cited

U.S. PATENT DOCUMENTS

| | | | |
|---|---|---|---|
| 2,668,055 | 2/1954 | Sharp et al. | 482/46 |
| 3,184,234 | 5/1965 | Struble | 482/46 |
| 3,211,453 | 10/1965 | Williams | 482/46 |
| 3,870,589 | 3/1975 | Shobert | 384/300 |
| 4,337,937 | 7/1982 | Lopez | 482/46 |
| 4,504,164 | 3/1985 | Bien | 403/379 |
| 4,830,361 | 5/1989 | Hoffman | 482/50 |
| 5,244,442 | 9/1993 | Schill | 482/46 |

*Primary Examiner*—Richard J. Apley
*Assistant Examiner*—Jeanne M. Mollo
*Attorney, Agent, or Firm*—Sherman and Shalloway

[57] ABSTRACT

Disclosed is an exercise device for use in developing and toning hand, arm, wrist and upper body muscles. The device defines a frictional rotation exercise stick which includes a mounting bar upon which two handgrip elements are rotatably mounted. Located between these two handgrip elements is a center stop collar to prevent one of the handgrip elements from being pushed off of one end of the mounting bar when an inwardly directed force is exerted on the other handgrip element. A cylindrical weight is screwthreaded onto each end of the mounting bar and end stop collars are disposed between these weights and the handgrip elements. Compression bias and friction elements are provided between the end stop collars and the handgrip elements to provide an increase in rotational resistance of the handgrip elements in response to a tightening of the cylindrical weights against the stop collars while retaining a smoothness of operation. The relationship between the handgrip elements, the compression bias means, the end stop collars, the center stop collar and the mounting bar reduces the tendency for rotation of the handgrip elements to be transferred to the cylindrical weights thus preventing a backing off of the compression bias applied. In addition, this structure provides an exercise device which features variable tension resistance and smoothness of operation which promotes efficient exercise.

13 Claims, 3 Drawing Sheets

EXERCISE DEVICE

This application is a continuation-in-part of Ser. No. 07/990,087, filed Dec. 14, 1992, now abandoned.

BACKGROUND OF THE INVENTION

1. Field of the Invention

The present invention relates generally to exercise devices and more particularly to a device for use in exercising, developing and toning hand, arm and wrist muscles and upper body muscles.

2. Description of the Prior Art

Various sports including golf, tennis and baseball require that the players have unusually strong wrist, hand and arm muscles. Even football players, especially offensive linemen, require particularly strong hand, arm and wrist muscles to facilitate their blocking assignments. Moreover, a lack of conditioning of certain muscles may result in various chronic ailments which cause pain and lessen enjoyment and abilities in the pursuit of athletic activities. For example, weakness of the lateral epicondyle of the humerus causes the common "tennis elbow" which may hinder the professional athlete in pursuit of his goals for success and which may dissuade the recreational player from enhancing his skills and furthering his enjoyment. Another commonly recognized problem is that of "golfers elbow" which is caused by weakness of the medial epicondyle of the humerus. This condition can also hinder both the professional and recreational golfer in pursuing their respective goals. The most common method of strengthening those muscles has been in the use of free weights which the athlete uses in wrist curl exercises. Such exercises have proven successful in merely strengthening, for example, the wrist. However, they are not particularly useful in strengthening the entire hand, wrist and arm sections and they also have proven detrimental to the flexibility of the joints.

One prior art device has been proposed in an attempt to overcome the above-described deficiencies. This exercise device is disclosed in U.S. Pat. No. 3,184,234 to Struble. Struble provides a device in which handgrips are mounted on a mounting bar such that they can rotate with respect to one another. Adjustable end members 22 are threaded onto the ends of the mounting bar to maintain the handgrips therebetween and to provide adjustment of the amount of friction which opposes rotation of the grip members. The Struble exercise device, however, is somewhat undesirable in use because, if the user is not careful during adjustment, he may cause the device to disassemble by tightening down on one end while the opposite end loosens, thus pushing the grip members off of the end of the mounting bar. Furthermore, upon extended use, the tension producing parts wear and the device tends to become less resistant to turning and thus frequent adjustment is required. In particular, lock washers positioned between the ends of hand grips and the adjustment knobs have rectangular apertures which fit over rectangularly undercut ends of the central rod. As the hand grips are rotated, the washers also attempt to rotate and wear their central apertures. More rotation is therefor transmitted to the adjustment knobs causing them to loosen and tension to back off. In addition, the rotational motion of the device may become sharp and jerky producing unwanted strain on the muscle groups being exercised. The device is also relatively light in weight. Because of this, the advantages attained in using free weights are not realized during the use of this prior art device. That is, by exercising with relative heavy weights a greater variety of muscles are affected during the exercise and the exercise will provide more effective and acute muscle toning and development.

Other prior devices include those of Lopez, U.S. Pat. No. 4,337,937; Williams, U.S. Pat. No. 3,211,453; Zinken, et al. U.S. Pat. No. 3,649,008; Petrosky, U.S. Pat. No. 4,982,950; Sloan, Jr., U.S. Pat. No. 684,117 and Goddard, British 161,282. However, none of these devices provide the combination of elements of the present invention whereby variable friction resistance is obtained in combination with smooth exercising motion while overcoming the mechanical disadvantages of Struble.

SUMMARY OF THE INVENTION

The present invention provides a variable tension and resistance exercise device for use in developing and toning arm, hand, wrist and upper body muscles, wherein the device is capable of variable resistance adjustment and smooth operative motion for efficient and useful exercise while avoiding or overcoming the inherent disadvantages of the prior art devices.

In accordance with the present invention, there is provided a mounting bar upon which two handgrip elements are rotatably mounted. Between these handgrip elements on the mounting bar there is fixably mounted a center stop collar which prevents the pushing off of one of the handgrip elements by the other handgrip element because the center stop element insulates each handgrip element from any inwardly directed force exerted on the other handgrip element.

Each end of the mounting bar is screwthreaded to receive a cylindrical shaped weight with a screwthreaded bore therein. Located on the mounting bar between each handgrip element and each end weight, respectively, is an end stop collar of substantial thickness having a set screw acting against a flat surface of the mounting bar or other means to prevent rotation of the collar. However, the end stop collars are permitted to be displaced slightly axially inwardly toward the handgrip elements upon screwing the end weight compressively thereagainst. Such inward adjustment of the end weights causes frictional resistance to the turning of the handgrip element to increase correspondingly.

Between each end stop collar and its respective handgrip is a compression assembly comprising a rubber compression member flanked by flat washers. Inward adjustment of the end weights compresses these assemblies between the end collars and the handgrips which, in turn, increases the frictional resistance of the handgrips. Additional washers of a material which provides a variable degree of friction depending on the level of compression while allowing slippage of adjacent parts facilitate rotation of the compression assemblies relative to the end stop collars even under tight compression, thus preventing transmission of handgrip rotation to the end collars and thence to the end weights. Additional washers of this material are preferably placed between the end collar and end weights and between the handgrip elements and the center stop collar.

Accordingly, it is an object of the present invention to provide a device which allows for the development and toning of a unique combination of muscles.

It is a further object of the present invention to provide an exercise device which is relatively inexpensive and useful for developing and toning hand, wrist, arm and upper body muscles.

It is yet another object of the present invention to provide a friction exercise device which combines the advantages of free weights with the advantages of a frictional rotation exercise device.

It is a still further object of the present invention to provide a friction rotation exercise device which allows for adjustment of the frictional resistance while maintaining a smooth rotation of the handgrip elements.

Yet another object of the present invention is to provide a frictional rotation exercise device which has two end adjustments, yet does not allow accidental disassembly of the device.

A further object of the present invention is to provide a frictional rotation exercise device which tends to retain a constant frictional resistance during continued use.

The present invention will be more fully described hereinbelow in connection with the accompanying drawing figures.

BRIEF DESCRIPTION OF THE DRAWING FIGURES

DETAILED DESCRIPTION OF THE INVENTION

Figure 1:
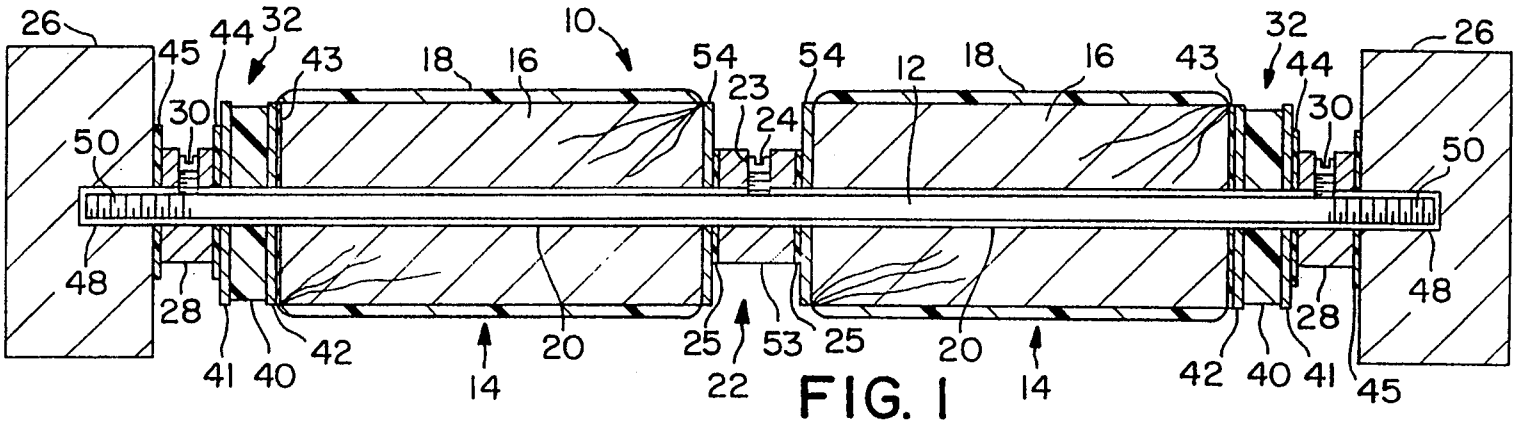
FIG. 1 shows an elevation view, in cross-section, of the rotation exercise stick of the present invention.
Figure 2:
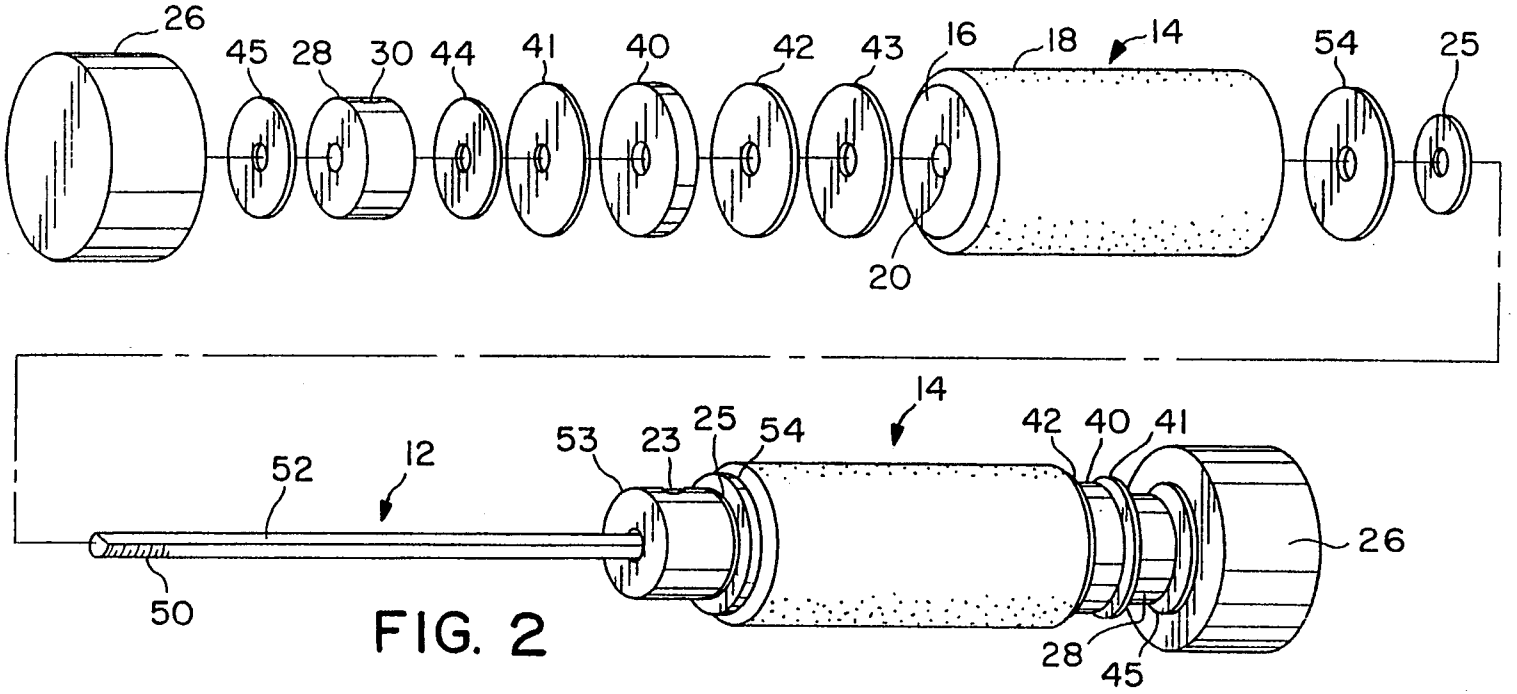
FIG. 2 shows an exploded view of the exercise stick of FIG. 1.
Figure 3:
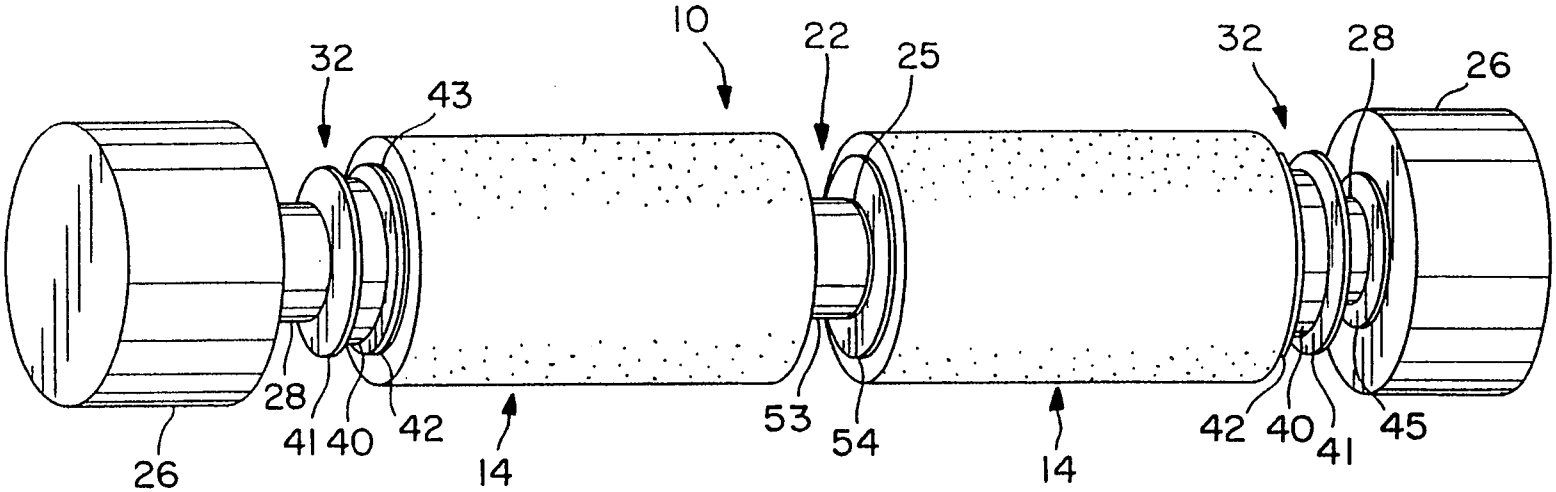
FIG. 3 shows an oblique view of the exercise stick of FIG. 1.

The exercise device of the invention will be described with reference to FIGS. 1 and 2. The handgrip exerciser 10 includes a mounting bar 12 which is preferably formed of steel and is of a circular cross section, except for one flat side thereof shown at 52.

Rotatably mounted on the mounting bar are two handgrips 14 having a cross-sectional diameter of 1–2 inches, preferably about 1½ inches. While the handgrips can be formed of various materials in the preferred embodiment, they include a dowel 16 with a centrally located longitudinal bore 20 therethrough. A handgrip material 18 is fit onto the outer periphery of the dowel 16 so as to provide a comfortable handgripping portion. This handgrip material may be of various materials that provide cushioning and wear resistance, including cushioned tape, leather, vinyl backed foam, or the like, but is preferably formed of nitral foam. The grip material may be either friction fit over the dowel 16 or bonded thereto by means of any suitable adhesive. The dowel 16 is preferably made from wood but may also be made from solid plastic, aluminum, or similar material with the centrally located longitudinal bore 20 therethrough.

Located centrally on the mounting bar 12 is a center stop means 22 which is fixedly mounted to the center of the bar by a screw 24 which bears against the flat portion 52 of the mounting bar 12 with sufficient force to prevent rotation and axial shifting of center stop means 22. In the preferred embodiment, the screw 24 is of the Allen screw type and is permanently set within its aperture 23 of the collar 22 by a commercially available adhesive such as Loc-tite. Flat or round head screws may also be used.

Center stop means 22 may be a single cylindrical member which may have a diameter equal to that of dowels 16 and a central bore for passage of bar 12. More preferably it is a smaller diameter collar 53, as seen in FIG. 1, having a diameter of from ½" to ¾" and a thickness of from ¼" to ½". Washers 54 having diameters equal to that of dowels 16 are mounted against the inner ends of handgrip elements 14 to prevent wear on the ends of dowels 16 by collar 53. Washers 54 have centrally located round holes corresponding to the bore 20 of dowels 16 for passage of mounting bar 12 and to allow washers 54 to rotate.

The handgrip elements 14 are mounted on the mounting bar 12 on opposite sides of the center stop means 22. Sandwiched between the center stop collar 53 and the washer 54 on each side of the center stop collar 53 is a washer 25 mounted over the mounting bar 12 and made from a material which provides a variable coefficient of friction depending on the level of compression to which it is subjected and of substantially the same diameter as the center stop collar 53. The washers 25 may have a larger diameter but must be at least as large as center stop collar 53. A preferred material for washers 25 is carbon impregnated polytetrafluoroethylene such as DuPont TEFLON which provides the variable coefficient of friction as well as a degree of lubricity which is necessary for effective rotation of the handgrip elements 14 relative to center stop collar 53 so that the rotation is smooth even when the level of friction is high, Other materials may be used; however, the inventor herein has found that the optimum material is TEFLON impregnated with carbon to a level of 20–25% by weight. By using washers made of this material in the structure of the exercise device herein, the inventor is able to provide a device wherein the level of frictional resistance can be varied while maintaining a smoothness of operation which enhances the useability of the device. In addition, the degree of lubricity offered by the TEFLON reduces the incidence of wear which has been a problem in other devices of this type. The smoothness of operation coupled with the variable friction resistance is important to efficient exercise. If the carbon content is too low, it is not possible to obtain the friction which provides the variable resistance for exercise. Similarly, if the carbon content is too great, the level of friction becomes such that the rotation of the handgrips 14 becomes jerky and uneven which is counterproductive to efficient and useful exercise.

End stop collars 28 are mounted on the mounting bar 12 outside of the handgrip elements 14. These collars 28, as with the central stop means 22, may include screws 30 which are tightened down against the flat side 52 of the mounting bar 12. These screws 30 prevent rotation of the end stop collars 28 and also prevent the collar from being pushed or taken off of the end of the mounting bar 12. They may be set in as shown in the drawings or they may be round or flat head screws of appropriate size. However, screws 30 are not so tight as to prevent slight axial movement along bar 12 in response to tightening of end weights 26. End stop collars 28 are preferably the same size as the center stop collar 53.

Sandwiched between end stop collars 28 and handgrip elements 14 are compression assemblies 32 comprising rubber compression elements 40 mounted over the mounting bar 12 and steel washers 41 and 42 mounted on bar 12 on either side of the rubber compression element 40. The rubber element 40 and washers 41 and 42 all have centrally located holes which are round in shape. In this manner, the compression assemblies may turn upon mounting bar 12 with handgrip elements 14.

Rubber elements 40 are made from a rubber composition having a durometer hardness of from 80 to 100. This level of hardness is important to the invention since, if it is too low the rubber element will be caused to extrude out from between the washers 41 and 42. Conversely, if the hardness level is too high, the range of tension adjustment possible with the device will be reduced since the compressive force generated will be more completely passed directly to the handgrips 14 and, thereby, to the center stop means 22. The preferred range of durometer hardness is 85–95 with a most preferred range being 85–90 durometer. The inventor herein has found that the combination of rubber elements 40 having a hardness of most preferably 85–90 durometer and the variable friction washers 25 of 20–25% carbon impregnated TEFLON when employed in the structure of the exercise device of this invention result in a wide range of adjustable tension not previously obtainable in such devices. Furthermore, the combination produces a smooth rotation of the handgrips 14 when the exercise device is used without any jerkiness of motion caused by parts catching or dragging which jerkiness can put excessive strain on the muscles being exercised. It is well established that smooth, non-jerking force or operation of equipment is desired for proper, even exercise of muscle groups. Sudden jerky or sharp movements of equipment do not produce smooth, even extension and contraction of muscles during exercise and, instead, place excessive stress and strain on the muscles which can cause injury and reduce the efficiency of the exercise being performed.

Each end of the mounting bar 12 includes a threaded portion 50. This threaded portion 50 provides two functions. First, it allows the screw of the end stop collar 28 to be tightened down to an extent where the collar 28 can move slightly in the axial direction, yet not move over the end of the mounting bar 12 because it contacts the threaded portion 50. The threaded portion 50 also provides for the rotatably adjustable receipt of end weights 26. These end weights 26 are preferably cylindrical and may be formed of cold rolled steel or other suitable material. They each include a tapped bore 48 formed into one end thereof so as to receive the threaded end portion 50 of the mounting bar 12.

Washers 54 prevent excessive wear of the dowel 16 which forms the handgrip element 14 on the ends adjacent center stop means 22. A protective washer 43 formed preferably of the carbon impregnated TEFLON material previously discussed is disposed on the mounting bar 12 adjacent the outer end of each dowel 16 between the dowels and compression assemblies 32. Similar carbon impregnated TEFLON washers 44 and 45 are disposed on the mounting bar 12 between each of the respective end stop collars 28 and end weights 26 and between end stop collars 28 and compression assemblies 32. Preferably, however, the washers 45 are of pure virgin TEFLON and the washers 44 are of carbon impregnated TEFLON. Alternatively, carbon impregnated TEFLON washer 43 may be eliminated and compression assembly washer 42 may be fixed to the end of dowel 16 so that relative rotation of handgrips 14 and compression assemblies 32 is eliminated and, instead, relative rotation takes place between the compression assembly handgrip combination and end stop collar 28 due to the lubricity factor of carbon impregnated TEFLON washer 44. Being made of the carbon impregnated TEFLON material, washers 44 contribute to the level of friction induced tension upon compression by tightening the end weights 26 against the end stop collars 28. These washers allow the end weights 26 to be compressively threaded against the handgrip elements 14 without binding and assist in the turning of compression assemblies 32 upon mounting bar 12, relative to the end stop collars 28.

Figure 5:
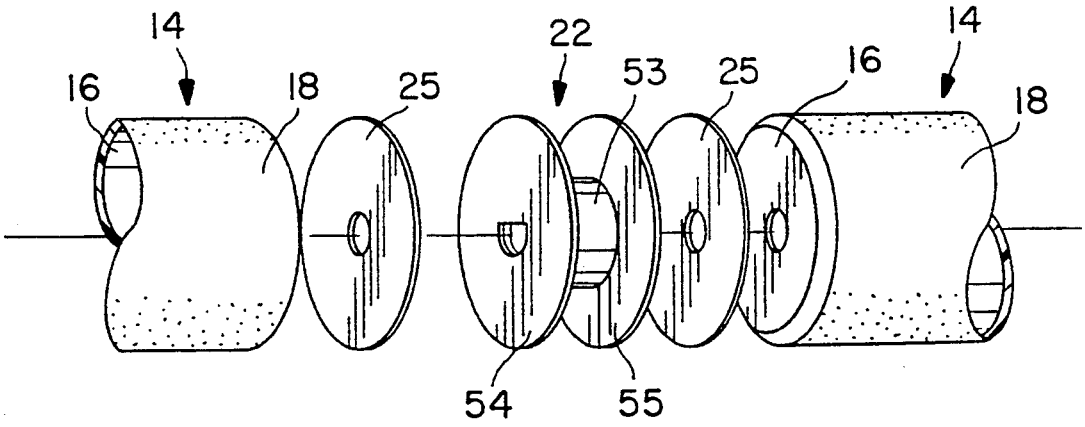
FIG. 5 shows an exploded view of an alternative center stop collar assembly of the present invention.

In an alternative embodiment, illustrated in FIG. 5, center stop means 22 may be built up from a smaller diameter stop collar 53 with large diameter washers 54 positioned on either side and attached to the collar by means of an appropriate adhesive or by welding. In this embodiment washers 54 will then have centrally located holes shaped with a flat side to correspond to the cross-sectional shape of mounting bar 12. This shape together with screw 24 will prevent center stop means 22 from turning upon mounting bar 12. This construction may also be achieved by a single molding or casting in various materials including reinforced polymers, sintered metal powder and the like. With this construction, the carbon impregnated TEFLON washers 25 will be positioned between washers 54 and the inner ends of dowels 16 and will be the same diameter as dowels 16 to facilitate the tensioned rotation of the handgrip elements 14 relative to center stop means 22.

Figure 4:
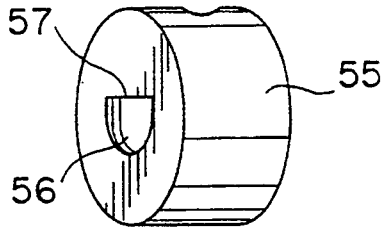
FIG. 4 shows an oblique view of an alternative form of stop collar employed in the exercise stick of this invention.

Also alternatively, center stop collar 53 and end stop collars 28 may be formed with central bores having a flat area corresponding to the flat portion 52 of mounting bar 12. FIG. 4 shows a representative form of such a collar 55 with bore 56 having flat area 57 extending longitudinally at least partway along bore 56. Preferably, the dimensions of bore 56 and flat 57 are in close tolerance with the shape and size of bar 12 to provide a tight fit and prevent any attempted rotational movement of collar 55 thereon. In addition, the thickness of the collar 55 eliminates the tendency for the bore 56 to wear against the bar 12 which is a problem in the prior art devices. Where this configuration is used, screws 24 and 30 may be eliminated, although it is preferred that screw 24 in center stop collar 53 be retained to secure against lateral movement of collar 53 along bar 12.

In operation, the user grips each handgrip element 14 with one of his hands and rotates it back and forth while retaining his grip. Various exercises can be performed with this handgrip exercise device, such as a simple exercise in which the user grips each handgrip element holding his arms straight out in front of him with his palms down and rotates each handgrip element back and forth to the extent which he is able. This rotating action exercises, tones and develops arm, hand and wrist muscles. When the user holds the weighted device outwardly from his chest it also provides upper body muscle toning and development. Another example of an exercise which can be performed with the device is that of gripping the handgrip elements with each hand in opposite directions and holding the device outwardly such that the user's arms are straight out in front of him and his hands are positioned one above the other. He then rotates the handgrip elements, as in the first noted example, to the full extent he is able.

It should be noted that with the present device, various amounts of end weight can be provided on each end of the bar by the provision of larger or smaller end weight elements 26. In the preferred embodiment, the two weights total either 2, 3, 4 or 5 pounds. The frictional resistance to turning of each handgrip element may be adjusted by rotation of either one or both of the end weights 26. Rotation in one direction causes the end weights 26 to press axially inwardly upon the end stop collars 28, the grip elements 14, and the compression assemblies 32. The rubber compression elements 40, of course, tend to provide a resistance force both outwardly against the inward adjustment of the end weights and inwardly against the handgrips, thus, the resistance adjustment is variable and evenly distributed across all levels of tension. This even distribution is a direct result of the durometer hardness of the rubber elements 40 which is sufficient to prevent them from being extruded from between the washers 41 and 42 but not so hard that they are not compressible. The fixed nature of center stop means 22 provides a fixed stop against which the resistance force of the compression assemblies 32 can push. In a similar manner, center stop means 22 prevents tightening of one end of the device from loosening or pushing off the other end of the device and allows the resistance of each hand grip to be independently adjustable.

Thus, it can be seen that the handgrip exercise device 10 of the present invention can be used by persons of all ages and strengths. For those with less developed hand, wrist, arm and upper body muscles, relatively light end weights 26 can be used and the end weights 26 can be adjusted such that relatively small frictional forces act against the rotation of the grip elements 14. Conversely, those with more developed muscles can use larger end weights 26 and adjust them inwardly such that a greater resistance force acts against the turning of the grip elements 14.

Various changes and modifications may be made to the preferred embodiments disclosed without departing from the spirit and scope of the present invention. Thus, it is to be understood that the invention is to be limited in scope only by the appended claims.

What is claimed is:

1. An exercise device comprising:

an elongated mounting bar with first and second end portions;

first and second grip members rotatably mounted on said elongated mounting bar;

center stop apparatus fixedly mounted on said mounting bar midway between said first and second end portions and between said first and second grip members whereby axial movement of one of said grip members is prevented from causing axial movement of the other of said grip members;

first and second adjustable end members mounted on said end portions of said mounting bar for axial movement toward and away from said first and second grip members;

first and second adjustable tension apparatus positioned on said mounting bar between each of said first and second grip members and said first and second adjustable end members and comprising first and second compression bias members respectively mounted on said elongated mounting bar between each of said first and second grip members and said first and second adjustable end members;

first and second end stop members mounted on said elongated mounting bar between each of said first and second adjustable end members and said first and second adjustable tension apparatus, said first and second end stop members being fixed against rotation about said elongated mounting bar; and friction members mounted on said elongated mounting bar between said first compression bias member and said first end stop member and between said second compression bias member and said second end stop member;

whereby, said grip members, said center stop apparatus, said adjustable end members, said adjustable tension apparatus, said compression bias members, said end stop members and said friction members cooperate to provide a mechanism whereby resistance to rotation of said grip members is selectively variable in response to adjustment of said adjustable end members relative to said grip members, said compression bias members provide friction enhancing bias against said respective grip members upon inward adjustment of said adjustable end members, and whereby said friction members comprise means providing both friction and lubrication between said tension apparatus and said end members whereby a variable coefficient of friction is provided between said compression bias members and said end stop members whereby resistance to rotation of said first and second grip members with respect to said end stop members is variable with adjustment of said adjustable end members and relative rotation of said grip members occurs with a smoothness of motion at all levels of tension, and whereby resistance to rotation of each grip member is independently adjustable.

2. The exercise device as recited in claim 1, wherein said first and second adjustable end members comprise first and second solid cylindrical weights, a mounting bore being centrally formed in one end of each of said first and second solid cylindrical weights to receive said end portions of said mounting bar.

3. The exercise device as recited in claim 2, wherein said first and second end portions of said elongated mounting bar are externally screwthreaded.

4. An exercise device as recited in claim 2, wherein said first and second solid cylindrical weights are formed of steel.

5. The exercise device as recited in claim 1, wherein said friction members comprise at least one washer formed of carbon impregnated polytetrafluoroethylene material mounted between said first compression bias member and said first end stop member, and at least one washer formed of carbon impregnated polytetrafluoroethylene material mounted between said second compression bias member and said second end stop member and wherein carbon is present at an amount of 20–25% by weight.

6. The exercise device of claim 5 further comprising additional friction members positioned between said compression bias members and said grip members, and between said grip members and said center stop apparatus.

7. The exercise device of claim 6 wherein said first and second compression bias members comprise a rubber body having a hardness of 85–95 durometer sandwiched between a pair of metal washers having a diameter equivalent to that of said grip members, said compression bias members having a central bore whereby said members are mounted on said bar between grip members and said adjustable end members.

8. The exercise device as recited in claim 1, further comprising wear resistant members, mounted on said elongated mounting bar adjacent each end of each of said first and second grip members, whereby said wear resistant members prevent wear of said first and second grip members.

9. The exercise device as recited in claim 8, wherein said wear resistant members comprise washers formed of wear resistant material mounted adjacent each end of each of said first and second grip members.

10. The exercise device as recited in claim 1, wherein said first and second compression bias members comprise rubber elements sandwiched between a pair of washers wherein said rubber elements have a durometer hardness of from 80 to 100.

11. The exercise device as recited in claim 6, wherein said elongated mounting bar has an essentially D-shaped cross section such that a flat side is formed along said elongated mounting bar, and said first and second end stop members include set screws radially disposed therethrough which bear against said flat side of said elongated mounting bar.

12. The exercise device as recited in claim 1, wherein said center stop means comprises a collar having an axial bore and a radial hole therethrough, said elongated mounting bar has an essentially D-shaped cross-section such that a flat side is formed along said elongated mounting bar, said collar is mounted on said bar by said axial bore with said radial hole perpendicular to said flat side of said bar and a set screw is disposed through said radial hole and in contact with said flat side of said elongated mounting bar.

13. The exercise device as recited in claim 1, wherein said first and second grip members comprise wood dowels having an axial hole therethrough and an outer covering of a foam elastomer.

* * * * *